US009091080B2

(12) United States Patent
Wilkie et al.

(10) Patent No.: US 9,091,080 B2
(45) Date of Patent: Jul. 28, 2015

(54) MORTARLESS MODULAR SIDING SYSTEM

(71) Applicant: DECO NAT INC., Bromont (CA)

(72) Inventors: Pierre Wilkie, Westmount (CA); Martine Morand, Montreal (CA); Ricardo Borja, Montreal (CA); Mike Streicher, Lasalle (CA); Bertin Castonguay, Magog (CA); Michel Bouchard, Riviere-des-Prairies (CA); Pierre Luc Duchesne, Shefford (CA); Benoit Deragon, Granby (CA)

(73) Assignee: DECO NAT Inc., Bromont, Quebec (CA)

( * ) Notice: Subject to any disclaimer, the term of this patent is extended or adjusted under 35 U.S.C. 154(b) by 0 days.

(21) Appl. No.: 14/197,624

(22) Filed: Mar. 5, 2014

(65) Prior Publication Data

US 2014/0182225 A1 Jul. 3, 2014

Related U.S. Application Data

(63) Continuation-in-part of application No. 13/451,965, filed on Apr. 20, 2012, now Pat. No. 8,707,649.

(60) Provisional application No. 61/477,436, filed on Apr. 20, 2011.

(51) Int. Cl.

| | |
|---|---|
| ***E04F 13/08*** | (2006.01) |
| ***E04B 1/70*** | (2006.01) |
| ***E04F 13/14*** | (2006.01) |

(52) U.S. Cl.

CPC ..... *E04F 13/0869* (2013.01); *E04B 1/7038* (2013.01); *E04F 13/0801* (2013.01);

(Continued)

(58) Field of Classification Search

CPC ..... E04F 13/0832; E04F 13/0801; E04F 13/0826; E04F 13/0869

See application file for complete search history.

(56) References Cited

U.S. PATENT DOCUMENTS

| | | | |
|---|---|---|---|
| 2,135,118 | A | 11/1938 | Stewart |
| 2,482,835 | A | 9/1949 | Bremer |

(Continued)

FOREIGN PATENT DOCUMENTS

| | | |
|---|---|---|
| CA | 1200706 | 2/1986 |
| CA | 2532845 A1 | 6/2007 |

(Continued)

OTHER PUBLICATIONS

U.S. Appl. No. 13/451,965, Office Action dated Feb. 7, 2013, 15 pages.

(Continued)

*Primary Examiner* — Andrew J Triggs

(74) *Attorney, Agent, or Firm* — Borden Ladner Gervais LLP

(57) ABSTRACT

A modular siding panel for mortarless application to a building structure is disclosed, which includes a structure for capturing and draining infiltrated water within the panel. In a preferred embodiment, the siding panel includes a rigid facing panel made of weather resistant material and having a front face exposed in an installed condition of the panel and top, bottom and side edges for engagement with like panels positioned adjacent thereto; and a supporting spacer fastened to the rear surface of the facing panel, the spacer including a mounting portion for attachment of the siding panel to the building structure and a water management portion for capturing infiltrated water which has seeped past the front face along one or more of the edges and draining the captured infiltrated water while sealed within the modular siding panel and away from the building structure.

21 Claims, 16 Drawing Sheets

(52) U.S. Cl.
CPC ..... *E04F13/0835* (2013.01); *E04F 13/0862* (2013.01); *E04F 13/0892* (2013.01); *E04F 13/141* (2013.01); *E04F 13/147* (2013.01); *E04F 13/0826* (2013.01); *E04F 13/0832* (2013.01)

(56) References Cited

U.S. PATENT DOCUMENTS

| | | | | |
|---|---|---|---|---|
| 2,624,298 | A | 1/1953 | Farren | |
| 2,872,804 | A | 2/1959 | Baldanza | |
| 3,613,326 | A | 10/1971 | Mollman | |
| 4,553,366 | A | 11/1985 | Guerin | |
| 4,665,675 | A | 5/1987 | Kelly | |
| 5,819,486 | A | 10/1998 | Goodings | |
| 5,885,502 | A | 3/1999 | DeAngelis et al. | |
| 6,951,086 | B2 | 10/2005 | Passeno | |
| 7,472,523 | B2 | 1/2009 | Beck | |
| 7,596,919 | B1 | 10/2009 | Hey et al. | |
| 7,694,477 | B2 * | 4/2010 | Kuelker | 52/302.3 |
| 8,042,309 | B2 | 10/2011 | Wolf et al. | |
| 8,707,649 | B2 * | 4/2014 | Wilkie et al. | 52/533 |
| 2007/0163188 | A1 | 7/2007 | Price | |
| 2009/0193742 | A1 * | 8/2009 | Wolf et al. | 52/311.1 |
| 2010/0146893 | A1 * | 6/2010 | Dickinson | 52/302.3 |
| 2010/0192495 | A1 * | 8/2010 | Huff et al. | 52/302.1 |
| 2011/0239578 | A1 * | 10/2011 | Wolf et al. | 52/588.1 |
| 2012/0272598 | A1 * | 11/2012 | Wilkie et al. | 52/302.3 |
| 2012/0291391 | A1 | 11/2012 | MacDonald | |
| 2014/0182225 | A1 * | 7/2014 | Wilkie et al. | 52/302.1 |

FOREIGN PATENT DOCUMENTS

| | | | |
|---|---|---|---|
| CA | 2714078 | A1 | 8/2009 |
| CA | 2661233 | A1 | 3/2010 |
| CA | 2728902 | A1 | 7/2011 |

OTHER PUBLICATIONS

International Patent Application No. PCT/CA2012/050256, International Search Report dated Jul. 17, 2012, 8 pages.
U.S. Appl. No. 13/451,965, Notice of Allowance dated Dec. 10, 2013, 8 pages.

* cited by examiner

MORTARLESS MODULAR SIDING SYSTEM

CROSS REFERENCE TO RELATED APPLICATIONS

This application is a Continuation in Part Application of U.S. Ser. No. 13/451,965, filed Apr. 20, 2012, which claims the benefit of priority of U.S. Provisional Patent Application No. 61/477,436 filed Apr. 20, 2011, both of which are incorporated herein by reference in their entirety.

FIELD OF THE INVENTION

The invention relates to the construction field and siding systems, more particularly to mortarless masonry type siding systems.

BACKGROUND OF THE INVENTION

Precast siding panels are often used for the exterior finishing of residential or commercial buildings. Known siding panels generally include a facing panel with design features simulating natural stone or brick or other masonry elements commonly used for the exterior finish of buildings. The design features can be machined or cast. Cast features are more cost efficiently manufactured. The facing panel is either directly mounted to the building wall or by way of stand-off or spacer elements which are mounted to the wall. The facing panels are either suspended from these elements or permanently connected therewith through embedded interlocking elements.

U.S. Pat. No. 5,819,486 discloses a veneer panel with embedded mounting clips and a spacer mounted to the building structure. The mounting clips extend into the spacer in the installed condition of the panel for mounting of the panel to the building. Water infiltration is prevented by sealing the joints between adjacent panels. However, sealing the joints is labour intensive and therefore uneconomical.

A cast veneer panel including a backing panel and a facing panel cast on the backing panel and interlocked therewith is disclosed in U.S. Pat. No. 8,042,309. The facing panel includes at least one design element. This cast veneer panel may include stand-off dimples to create a ventilation gap between the building and a back surface of the backing panel. The veneer panel can be mounted to a building with or without subsequent mortar application between the individual panels and/or the design elements. However, in the mortarless application mode, infiltration of water between the individual veneer panels is possible, especially under wind pressure. Although the infiltrated water can drain off under gravity in the ventilation gap, it will nevertheless come in contact with the building structure, at least at the stand-off dimples, increasing the danger of water infiltration into the building structure through breaks in the building wrap.

CA 2,661,233 discloses a mortarless siding system of cast stone bodies with embedded mounting supports for attachment to a building structure. Water infiltrating between adjacent stone bodies is kept away from the building structure by the mounting support above and below the stone bodies. However, infiltrated water can reach the building structure at the lateral joints between the mounting supports.

U.S. Pat. No. 4,553,366 discloses a mortarless siding system of cast facing plates with embedded hooks for engagement with the hooking section of a spacer for attachment to a building structure. Water infiltrating between adjacent stone bodies is drained away by oblique edges on the facing plates. However, water infiltration due to wind pressure cannot be avoided and will lead to water coming into contact with the building structure behind the hooked on facing plates.

US 2009/0193742 and US 2011/0239578 disclose prefabricated wall panels having a precast body with embedded mounting element for attachment to a building structure. The wall panel can be used for assembly of a mortarless siding. However, water infiltrated between adjacent panels can drain through the mounting element towards the building structure and come in contact with the building structure.

Numerous mortarless siding systems assembled from precast siding panels including embedded supporting spacers are known. In each, the supporting spacer is embedded into a rear surface of the siding panel during casting. However, since the spacer must be embedded into the siding panel, the panels must be wet cast and must remain in the casting mold until the material of the panel is set. Thus, the manufacturing process of these siding systems is relatively slow and uneconomical. Also, the need for embedding the spacer in the facing panel significantly limits the type of facing panel that could be used.

SUMMARY OF THE INVENTION

It is an object of the invention to overcome at least one of the disadvantages found in the prior art.

In one embodiment, the invention provides a modular siding panel for mortarless application, which includes a facing panel and a spacer fastened thereto, whereby the facing panel can be of any natural cast or manufactured material that is rigid and weather resistant. The spacer includes a water management structure for managing infiltrated water by capturing infiltrated water before it can reach the building structure and draining the captured infiltrated water. In particular, the water management portion of the spacer captures any infiltrated water that has seeped past the top edge, and preferably also water that has seeped past the side edges, and drains the captured infiltrated water while sealed within the modular siding panel, in order to avoid contact of the infiltrated water with the building structure. In a preferred embodiment, the mounting and water management portions are integral portions of the supporting spacer and the captured infiltrated water is drained in a drainage conduit formed within the spacer or by the spacer in combination with the rear face of the facing panel.

In another preferred embodiment, the invention provides a modular siding panel for the assembly of a mortarless modular siding on a building structure, comprising a facing panel made of any rigid, weather resistant material and a supporting spacer mountable to the rear surface of the facing panel. The facing panel has a front face exposed in an installed condition of the panel and a rear surface directed towards the building structure in the installed condition. The facing panel further has top, bottom and side edges for proximal placement to like panels positioned adjacent thereto, in order to achieve a substantially continuous siding surface. In a preferred variant, the facing panel is made of settable material. In another variant, the facing panel is a concrete panel, preferably a dry cast concrete panel.

In another preferred embodiment, the invention provides a spacer for a modular siding panel including the spacer and a facing panel connected to the spacer, which spacer includes a mounting portion for connecting to the facing panel and for fastening the spacer with connected facing panel to a building structure. The spacer further includes a water management portion with a trough for capturing infiltrated water which has seeped past the front face of the facing panel along a top edge of the facing panel and a drainage conduit for draining the infiltrated water, while maintaining the infiltrated water away from the building structure. The trough and/or the drainage conduit can be formed completely within the spacer or formed upon connection of the spacer to the facing panel by a section of the spacer in combination with the rear face.

In a preferred embodiment, the trough is formed by an L-shaped section of the water management portion and the U-shaped trough is formed in the installed condition by the L-shaped section and the rear face of the facing panel. In the same embodiment, the drainage conduit is formed by a U-shaped section of the water management portion and the rear face, whereby the open side of the U-shaped section is closed in the installed condition by the rear face of the facing panel. However, when the trough and drainage conduit are not formed within the spacer, a certain amount of water seepage may occur in the installed condition of the spacer on the facing panel, even when the rear face of the facing panel is flat. The inventors have now discovered, that this seepage can be minimized by providing the spacer with a pretension which will generate a contact pressure between the water management portion and the rear face in the installed condition, which contact pressure forces the water management portion against the rear face in a sealing manner.

In a preferred embodiment of the spacer, the spacer has a preselected curvature in at least one of its longitudinal and transverse directions. This generates a contact pressure between the spacer and the rear surface along the drainage channel, when the spacer is straightened against the facing panel during fastening of the spacer onto the rear surface. The straightening of the spacer is achieved by fastening the spacer against the rear surface at least at the longitudinal ends of the spacer, preferably at the corners of the spacer.

The mounting and water management portions are preferably integral portions of the supporting spacer.

The mounting portion in the installed condition of the siding system is fastened to the siding panel as well as the building structure. The mounting portion preferably includes a metal plate for reinforcement of the supporting spacer at the point of securement to the building structure and for providing maximum integrity of the siding system during a building fire. The metal plate is preferably protected from corrosion by an anti-corrosion finish or by embedding it into the material of the water management portion of the supporting spacer. In a further preferred embodiment, the water management portion is molded from plastics material and the metal plate of the mounting portion is fully embedded in the plastics material during molding of the spacer.

The water management portion includes a trough adjacent a top edge of the spacer for capturing and draining infiltrated water and for capturing water drained from above, for example from the drainage conduits of a modular siding panel positioned directly above. In the installed condition of the spacer, the trough engages the rear surface of the siding panel along the top edge to define a drainage groove with a trough shaped bottom for capturing the infiltrated water. The trough preferably extends substantially over a whole width of the spacer. More preferably, the trough further extends along one of the side edges for capturing water, which has seeped past the front face of the siding panel along the side edge, in the installed condition.

In one embodiment, the trough includes a drainage opening and the water management portion further includes the drainage channel connected to the drainage opening for forming with the rear surface of the siding panel the drainage conduit for channelling water flowing through the drainage opening toward the bottom edge. Thus, water flowing through the drainage opening is drained while being substantially sealed within the drainage conduit of the siding panel.

The supporting spacer preferably includes a mounting flange formed by overlapping sections of the mounting and water management portions. The mounting flange preferably extends along a top edge of the supporting spacer and the supporting spacer preferably further includes coupling elements for slidingly coupling a bottom edge of the spacer with the mounting flange of a like spacer positioned immediately below.

Preferably, the mounting flange and coupling members are parallel for automatic horizontal alignment of horizontally stacked like spacers.

The invention also provides a mortarless modular siding, comprising stacked rows of the modular siding panels in accordance with the invention.

The invention further provides a method of mounting a modular siding on a building structure, including the steps of obtaining multiple modular siding panels in accordance with the invention, mounting a horizontal row of at least two side by side siding panels on the building structure; and installing subsequent rows of like siding panels by interlocking the coupling member of each siding panel with the mounting portion of the horizontal row of panels, sliding the siding panel on the horizontal row to a desired location adjacent another like panel and fastening the mounting flange of the siding panel to the building structure.

In a preferred embodiment of this method, the step of obtaining multiple modular siding panels further includes the steps of obtaining an equal number of spacers and facing panels and fastening one of the spacers to each of the siding panels to assemble the modular siding panels.

BRIEF DESCRIPTION OF THE DRAWINGS

Exemplary embodiments of the invention will be further discussed in detail below with reference to the drawings, wherein.

DESCRIPTION OF THE PREFERRED EMBODIMENTS

Detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1A:
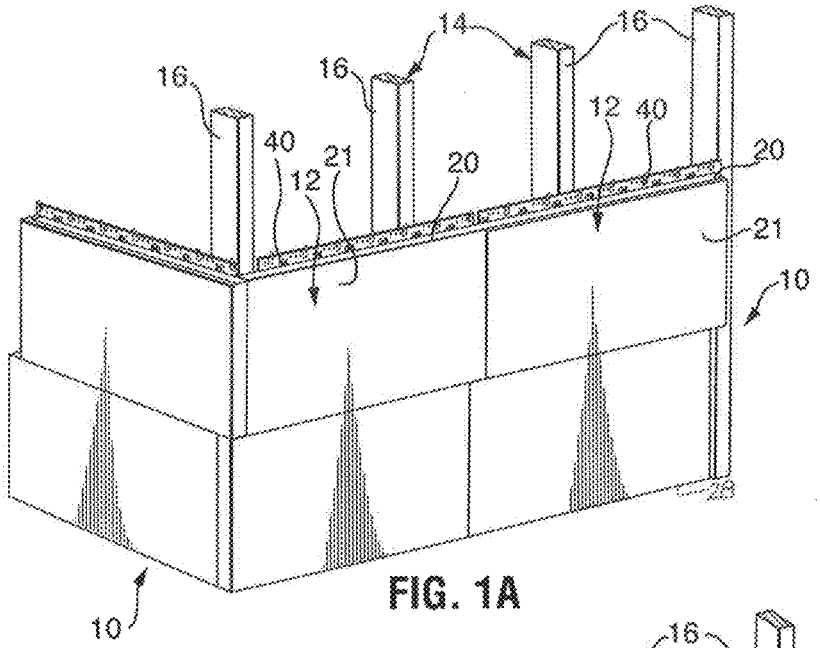
FIGS. 1A and 1B are perspective views of the mortarless modular siding system in accordance with the invention, using differently shaped siding panels in accordance with the invention.
Figure 1B:
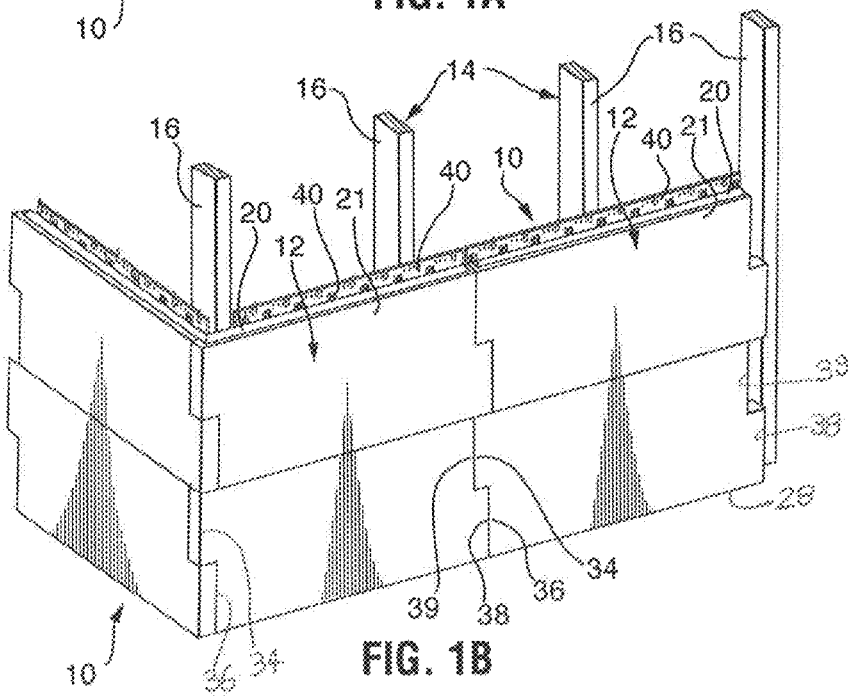
Figure 2:
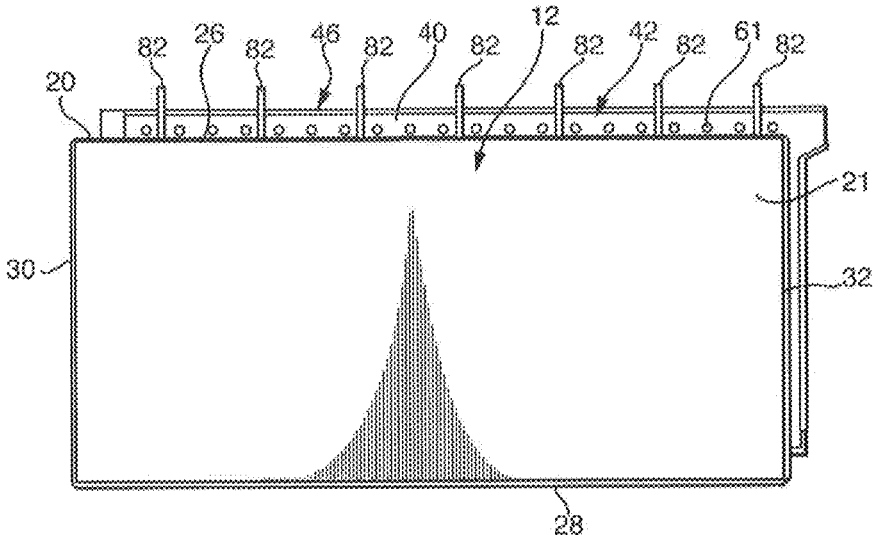
FIG. 2 is a front elevational view of a modular siding panel as shown in FIG. 1A.

In accordance with the present invention, and with reference to FIGS. 1A and 1B, a modular siding system 10 is disclosed. The modular siding system 10 allows for the convenient and secure attachment of modular siding panels 12 with a weather resistant facing to a static building structure 14 in a manner creating a weather resistant outer surface without the need to use mortar or sealant for sealing the siding and for holding the siding panels together. In order to minimize the chance of water damage to the building structure by water infiltrated across the siding, for example through the mortarless joints, the modular siding system further allows for the management of infiltrated water away from the building structure, namely the capture of infiltrated water before it can reach the building structure and drainage of the infiltrated water sealed within the modular siding panel to avoid contact of the infiltrated water with the building structure.

In accordance with the disclosed invention, the modular siding panels 12 are stacked, automatically aligned and coupled at the bottom of each siding panel 12 to a vertically adjacent siding panel 12 or a starter strip or starter rail 90 (see FIG. 5B), which is attached to the building structure 14 and forms the base of the siding system 10 (see FIGS. 1A and 1B).

Referring to FIGS. 1A, 1B, 2, 3, 4A, each of the siding panels 12 is substantially planar and includes a weather resistant facing panel 20 with a facing surface 21 and a supporting spacer 40 connected with the facing panel 20 along a back surface 22 of the facing panel. The facing panel can be made of any rigid natural or manmade material that is weather resistant.

Each of the siding panels 12 includes the supporting spacer 40 fastened to the facing panel for attachment to studs 16 positioned in the back-up wall (that is, wood stud, steel stud, etc.) of the static building structure 14 (a wood, steel, brick, cement structure or other). Any fastener type suitable for the respective facing panel material can be used for connection of the spacer 40 to the facing panel 20. TAPCON fasteners 41 are preferred for concrete facing panels. The supporting spacer 40 includes a mounting portion 42 for fastening the modular siding panel 12 to a vertical supporting surface of the building structure 14 and a water management or water evacuation portion 60 for capturing infiltrated water which has seeped past the front face before it can contact the building structure and draining the captured water sealed within the modular siding panel to avoid contact of the infiltrated water with the building structure 14. The mounting and water management portions 42, 60 can be integral portions of the supporting spacer 40, or separate elements combined into the supporting spacer 40, such as a mounting portion 42 formed as a metal plate 43 (see FIGS. 4A and 4B) embedded into the water management portion 60 formed as a plastics structure with fastener apertures 61 for fasteners to mount the siding panel 12 to the building structure 14 and fastener apertures 62 for the fasteners 41 (see FIG. 4A) connecting the spacer 40 to the facing panel 20.

In the illustrated embodiment, the supporting spacer 40 includes a mounting flange 46 for securing of the siding panel 12 to the building structure 14, which mounting flange 46 is formed by overlapping sections of the mounting and water management portions 42, 60 (see FIG. 4A), for reinforcement of the supporting spacer at the point of securement to the building structure. The individual components of the siding panels 12 will be described in more detail below.

Facing Panel

Referring now to FIGS. 1A, 1B, 2 and 3, the facing panel 20 includes a facing surface 21, a back surface 22, a top edge 26 extending between the front surface 21 and the back surface 22, a bottom edge 28 extending between the facing surface 21 and the back surface 22, and first and second side edges 30, 32 extending between the facing surface 21 and the back surface 22. The facing panels of the preferred embodiment illustrated in these Figures are made of a settable material, such as concrete. Most preferably, the facing panels are dry cast concrete panels with a three-dimensional structure imprinted into the facing surface, since they can be cost efficiently manufactured at high volumes and in a large variety of shapes and facing surface designs. The facing panel 20 may be made of any settable material that can be molded to achieve the desired appearance of the siding panels, especially any decorative embossment or three-dimensional shaping of the facing surface 21 to give the siding panel 12 the appearance of natural stone or of other masonry surfaces. Examples of settable materials are wet cast concrete, dry cast concrete, concrete mixtures including fibrous or plastic materials, resinous mixtures, etc.

The facing panel 20 may be rectangular in shape, as shown in FIG. 1A, or have a Z-shape as shown in FIG. 1B. Other shapes, such as square or irregular are also possible, as long as the shape can be assembled into a continuous surface covering with like siding panels of identical shape. In the Z-shaped embodiment of the facing panel 20 as illustrated in FIG. 1B, the first and second side edges 30, 32, which ultimately define the first and second side edges 30, 32 of the siding panel 12, are formed with an interlocking profile. In this preferred embodiment, the first side edge 30 is provided with a protruding upper section 34 adjacent the top edge 26 of the facing panel 20 and a recessed lower section 36 adjacent the bottom edge 28 of the facing panel 20. Similarly, the second side edge 32 is provided with a protruding lower section 38 adjacent the bottom edge 28 of the facing panel 20 of the siding panel 12 and a recessed upper section 39 adjacent the top edge 26 of the facing panel 20 of the siding panel 12. The protruding upper section 34 and recessed lower section 36 of the first side edge 30 are shaped to interlock with the respective recessed upper section 39 and the protruding lower section 38 of the second side edge 32 creating an enclosed siding surface with no space between the first side edge 30 and the second side edge 32 of adjacent facing panels 20 of the siding panels 12 (FIG. 1B). Preferably, the protruding and recessed sections are dimensioned such that the protrusion and/or recess is comparable in size to the thickness of the facing panel. This allows for the creation of an interlocked yet smooth corner assembly as shown in the left half of FIG. 1B.

As discussed above, each facing panel 20 is formed with a top edge 26 and a bottom edge 28. As with the first side edge 30 and the second side edge 32, the top edge 26 and the bottom edge 28 are shaped and dimensioned to form a mating relationship when the siding panels 12 are vertically stacked and horizontally abutted (see FIGS. 1A and 1B). The top edge 26 and the bottom edge 28 define straight edges as they extend from the first side edge 30 to the second side edge 32. As a result, when the top edge 26 is mounted next to a bottom edge 28 of an adjacent siding panel 12 and a continuous, closed siding surface is created, very little spacing remains between the top edge 26 and the bottom edge 28. In addition, the top edge 26 and the bottom edge 28 may be sloped away from the building as they extend from the back surface 22 of the facing panel 20 to the facing surface 21 of the facing panel 20, which results in a sloping seam that counteracts the seepage of water between vertically adjacent siding panels 12 (not illustrated). However, despite the close fit between adjacent panels 12, wind pressure may push water through the seam until the infiltrated water reaches the back surface 22 of the facing panel 20. Should infiltrated water get trapped behind the siding of a building, significant, humidity related damage can occur, which is why the siding panel 12 of the invention is provided with an infiltrated water management structure for capturing and draining the infiltrated water while sealed within the modular siding panel to avoid the infiltrated water reaching the building structure, as will be discussed in the following.

Supporting Spacer

Figure 3:
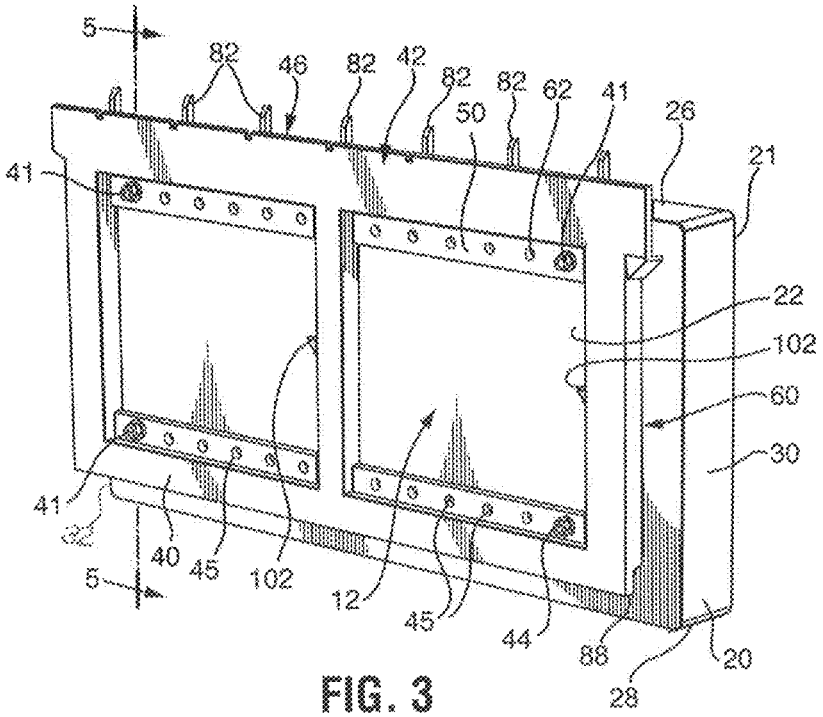
FIG. 3 is a rear perspective view of the siding panel of FIG. 2, showing the supporting spacer fastened to the rear face of the facing panel.
Figure 4A:
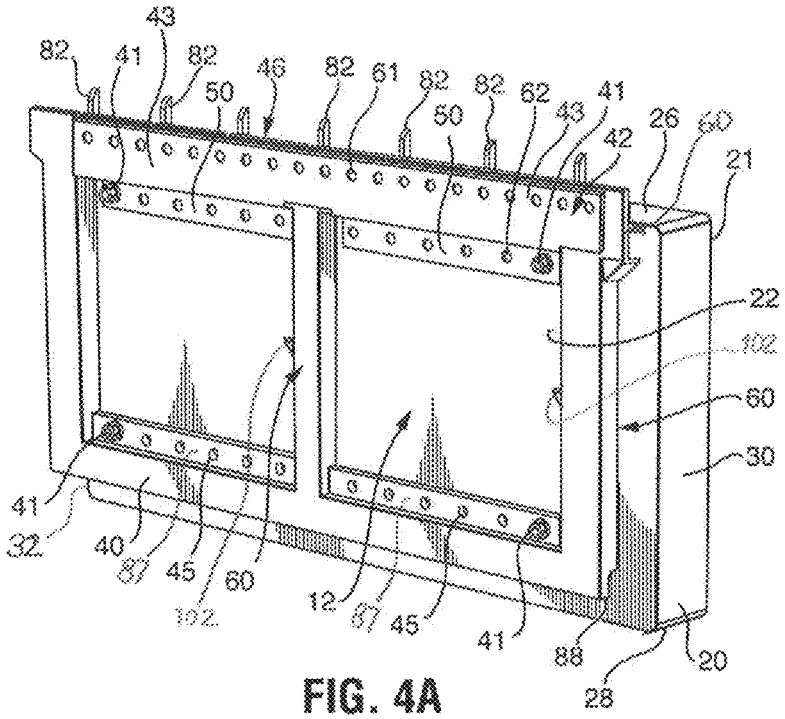
FIGS. 4A and 4B respectively show a partial cut-away view of the siding panel of FIG. 3, exposing the mounting section embedded in the spacer, and a perspective view of the mounting portion.
Figure 5A:
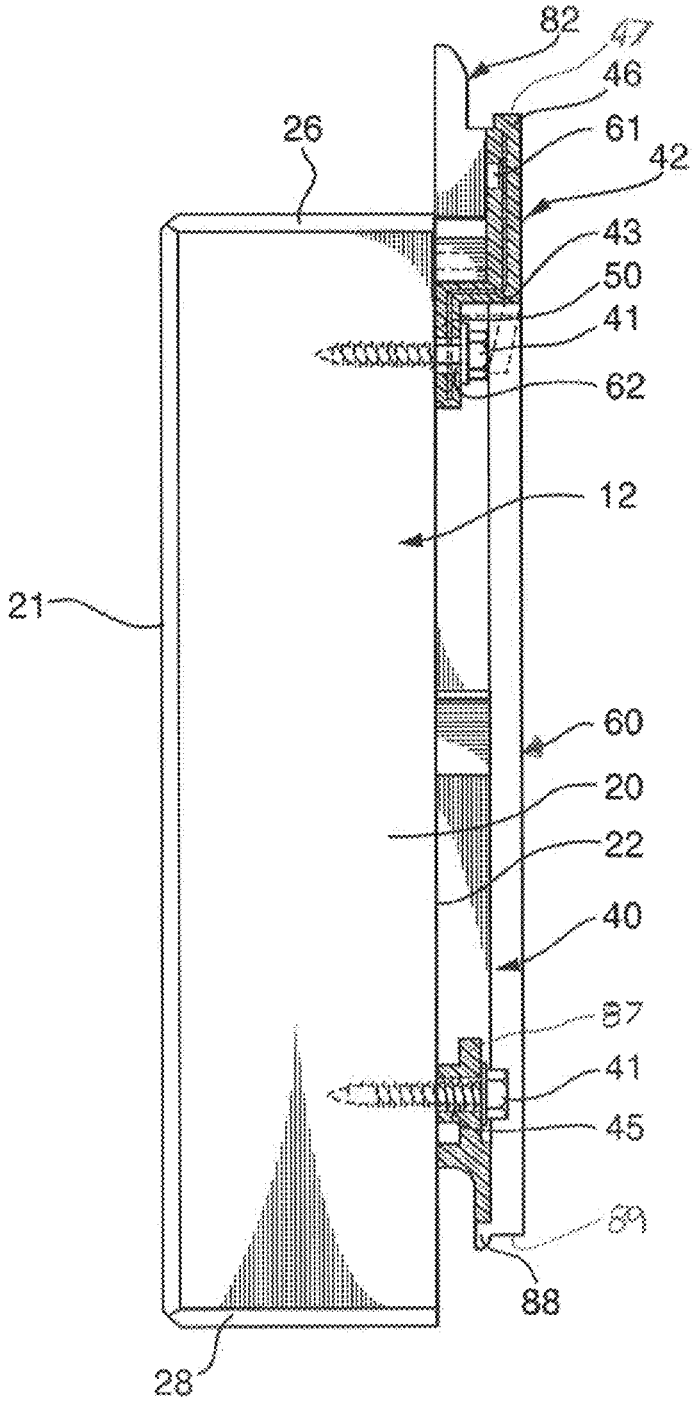
FIGS. 5A, 5B and 5C respectively show a cross-sectional view of the supporting spacer, taken along line 5-5 in FIG. 3 and a cross-sectional view of the supporting spacer as affixed to a building structure component.
Figure 5B:
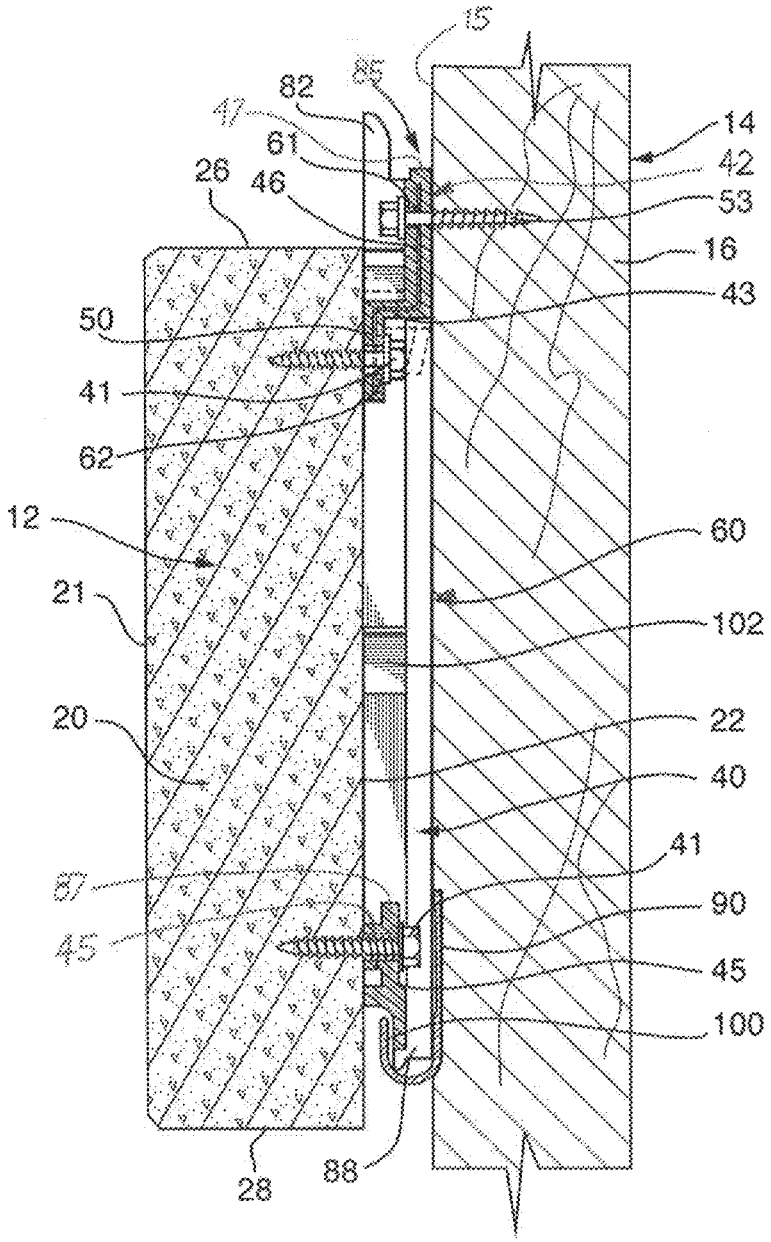
Figure 5C:
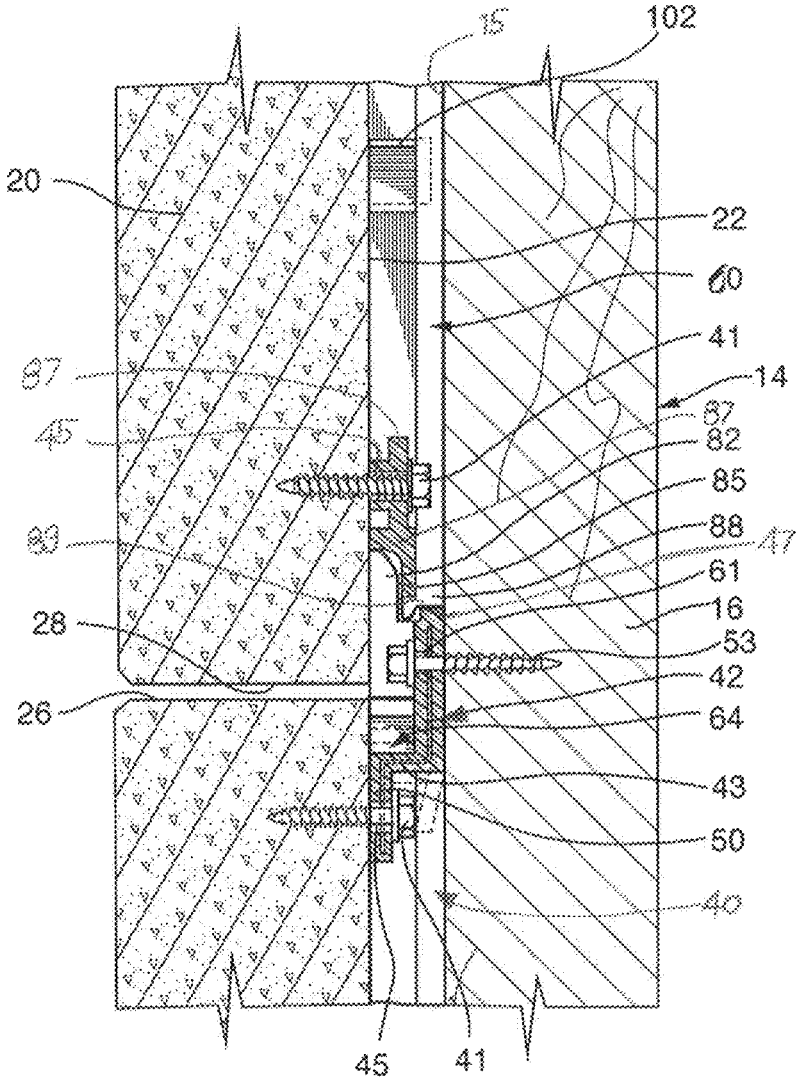
Figure 6:
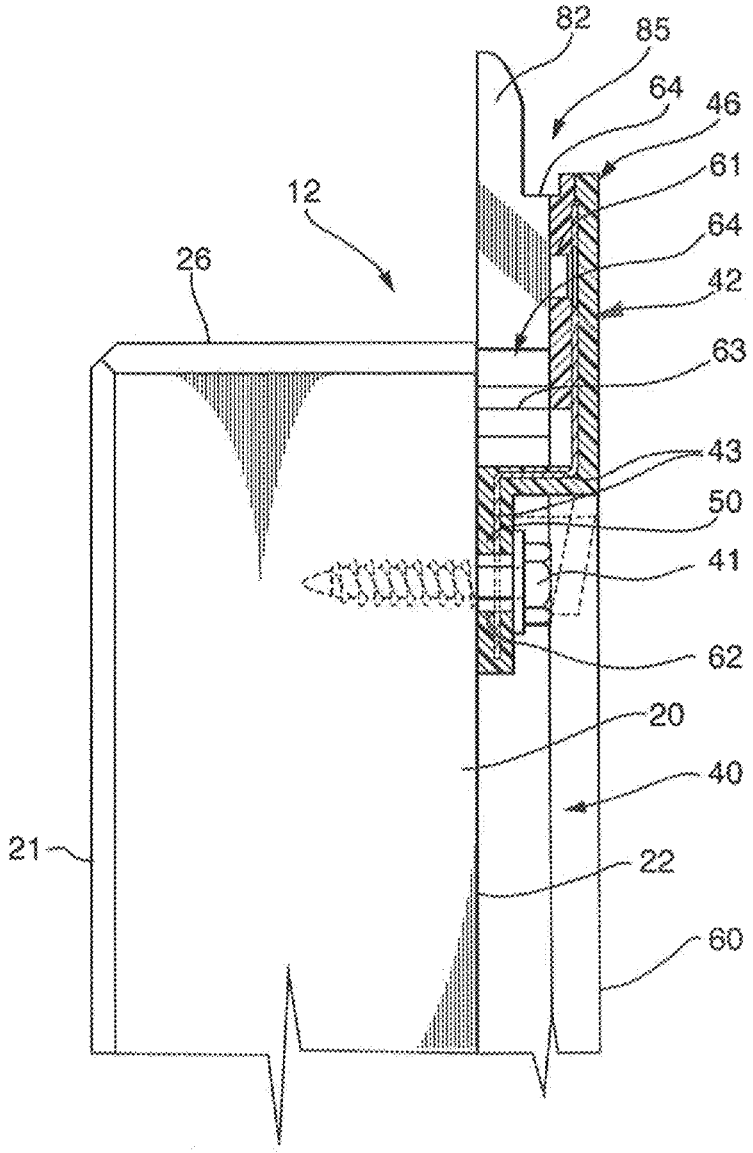
FIG. 6 is a partial cross-sectional view of the supporting spacer, showing the top end of FIG. 5 in more detail.

As is apparent from FIGS. 2, 3, 4A, 5A, 5B, 5C, 6 and 7, the present modular siding system 10 employs a supporting spacer 40, preferably made of a combination of steel and plastic components, fastened to the facing panel 20 of the modular siding panels 12. The supporting spacer 40 facilitates secure attachment of the siding panels 12 to the vertical supporting surface 15 (FIGS. 5B, 5C). The supporting spacer 40 is fastened to each of the siding panels 12 during the manufacturing process and, as will be appreciated based upon the following disclosure, provides a water management system including a trough for capturing infiltrated water and a drainage conduit for draining the infiltrated water while sealed within the siding panel.

Referring to FIGS. 2, 3, 4A, 5A, 5B, 5C, 6 and 7, the supporting spacer 40 is connected with the facing panel 20 to form a modular siding panel 12. As will be appreciated based upon the following disclosure, the supporting spacer 40 provides a mechanism for securing the top edge 26 of a lower siding panel 12 to the vertical supporting surface 15 (FIGS. 5B, 5C), while coupling to the bottom edge 28 of a like siding panel 12 positioned directly above (FIGS. 5A to 5C). Even though all of the siding panels 12 are identical in a preferred embodiment of the siding system of the invention, it is also conceivable that siding panels with differently shaped facing panels can be included, as long as they combine to form a continuous siding surface. However, the supporting spacers 40 are preferably of identical construction for all siding panels and, thus, the supporting spacer 40 will be described with reference to only one of the siding panels 12.

Mounting Portion

Figure 4B:
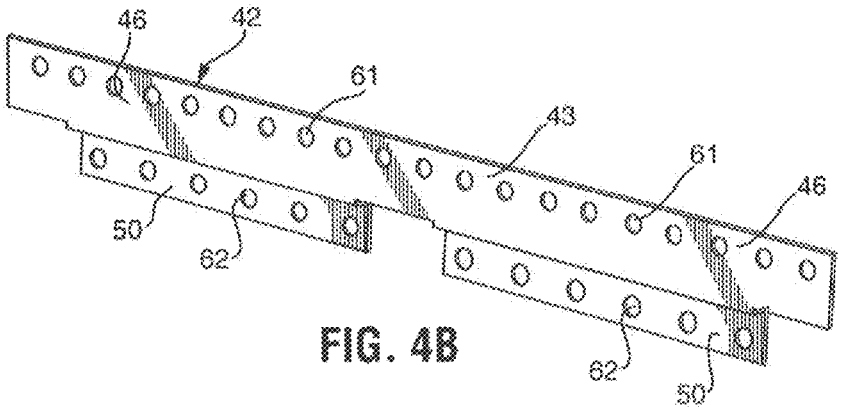

The supporting spacer 40 is in the following described with reference to the orientation when the siding panel 12 is coupled to the vertical supporting surface 15 (FIGS. 5B, 5C). The supporting spacer 40 includes a mounting portion 42 for fastening the siding panel 12 to the vertical supporting surface 15 of the building structure 14 adjacent the top edge 26, and a water management portion 60 for managing infiltrated water within the siding panel to maintain the infiltrated water away from the building structure. With the water management portion 60, infiltrated water which has seeped towards the back surface 22 is captured while it is still away from the building structure 14, which means before it comes into contact with the building structure, and the captured water is then drained while sealed within the siding panel. The mounting and water management portions 42, 60 can be integral portions of the supporting spacer 40, or separate elements integrated into the supporting spacer 40, as illustrated in FIGS. 4A and 4B. In the illustrated embodiment, the mounting portion 42 includes the mounting flange 46 for fastening to the building structure and an attachment flange 50 for connecting the spacer 40 to the facing panel 20. In the preferred embodiment, the mounting portion 42 is formed as a metal plate 43 having the mounting and attachment flanges 46, 50, with fastener apertures 61 in the mounting flange for receiving fasteners 53 (see FIGS. 5B and 5C), which fasten the siding panel 20 to the building structure and fastener apertures 62 in the attachment flange 50 for receiving fasteners 41 which anchor the spacer 40 to the facing panel 20. By forming the mounting portion from the metal plate 43, a reliable supporting of the siding panel 12 is achieved without any sagging due to material fatigue or excessive heat. It will be appreciated by the art skilled person that the siding panel 12, depending on geographic location of the installation and color of the facing panel 20, can become heated to elevated temperatures by sun exposure, at which temperatures plastics materials may be subject to sufficient softening to cause deformation or creep under the load of the facing panel. Although it is desirable to prevent sagging of the siding panels at elevated temperatures, it is even more desirable to maintain the siding panels reliably attached to the building structure in the case of a fire. By using a mounting portion made of metallic material, the siding panels will remain attached to the building structure for a much longer period of time during an incendiary incident, than if they were made of other materials much more easily deformed under heat, such as plastics. The mounting portion 42 is embedded into the material of the water management portion 60 for corrosion protection (see FIG. 4A). The siding panel 12 is fastened to the building structure 14 by way of a screw or bolt 53 (lag bolt for concrete structures), which tightly biases the mounting flange 46 against the supporting surface 15 of the building structure (see FIGS. 5B and 5C).

Water Management Portion

Figure 7:
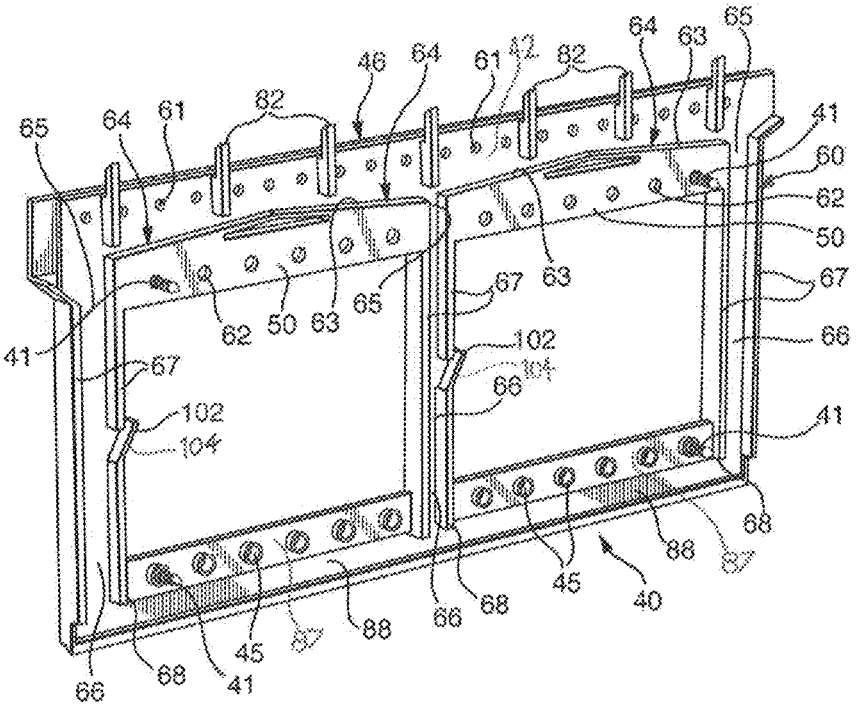
FIG. 7 is a rear perspective view of the supporting spacer included in the siding panel of FIGS. 2-4A.
Figure 8:
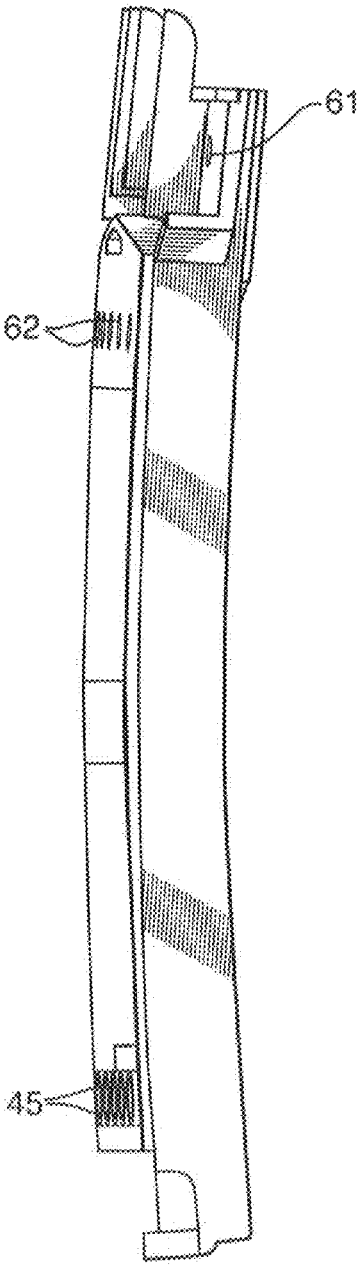
FIG. 8 is a side elevational view of the spacer of FIG. 7.
Figure 9:
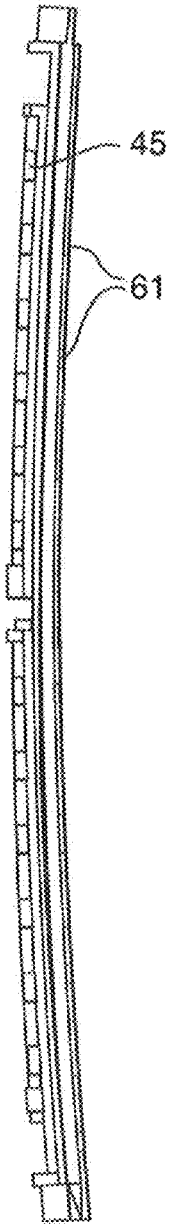
FIG. 9 is a top plan view of the spacer of FIG. 7.
Figure 10:
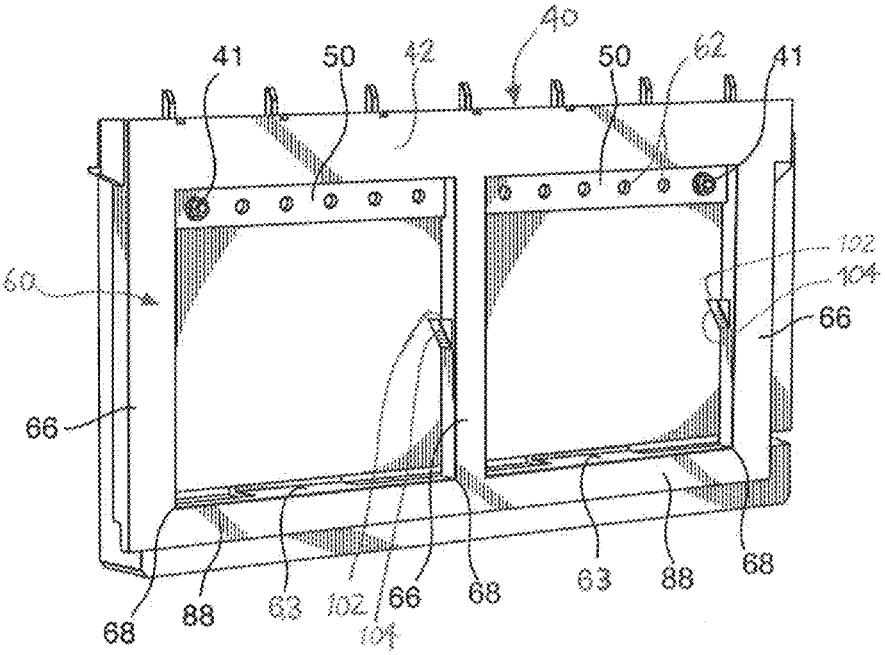
FIG. 10 is a variant of the modular siding panel of FIG. 3.
Figure 11:
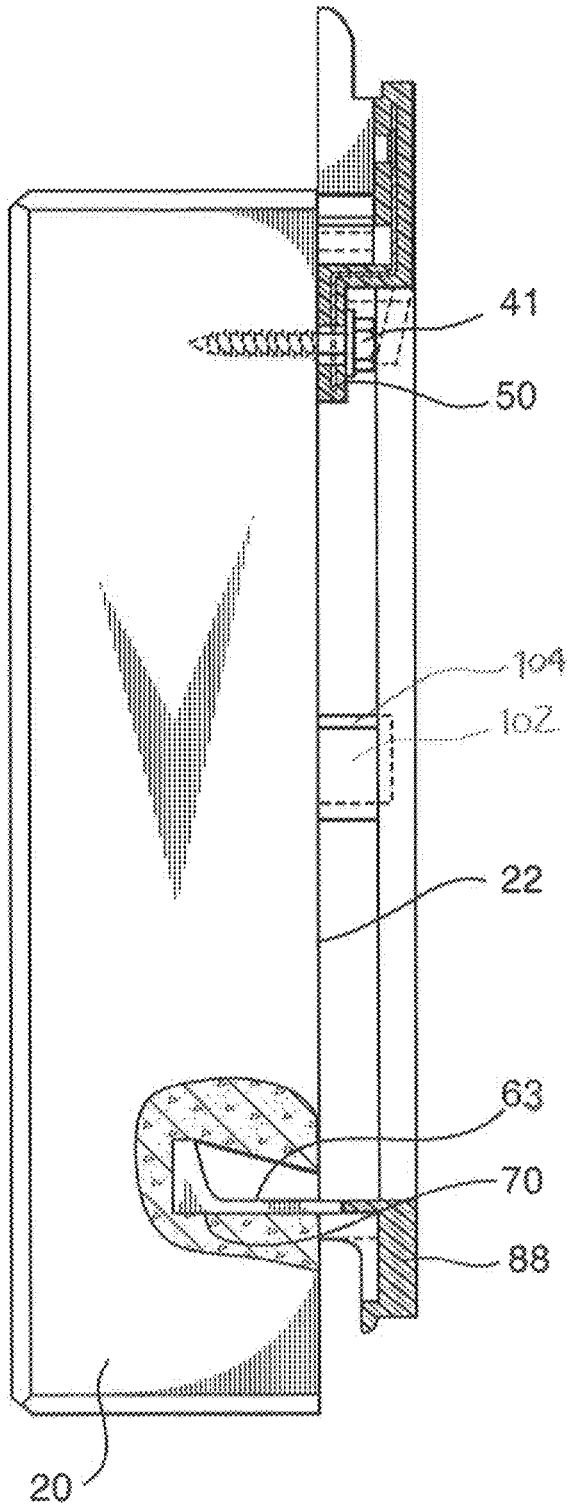
FIG. 11 is a cross-sectional view of the siding panel of FIG. 10, taken along line 11-11 in FIG. 10.
Figure 12:
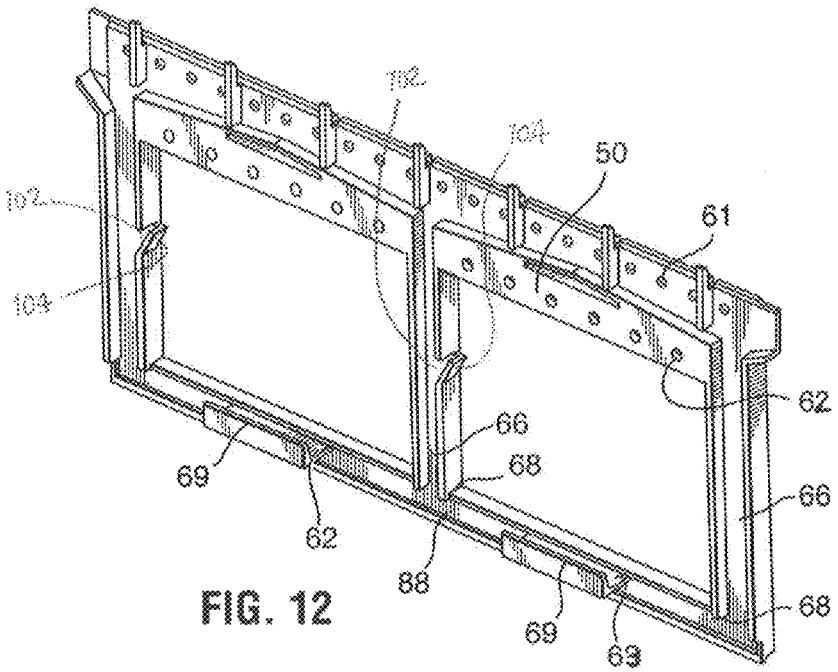
FIG. 12 is a rear perspective view of the spacer included in the siding panel of FIG. 10.
Figure 13:
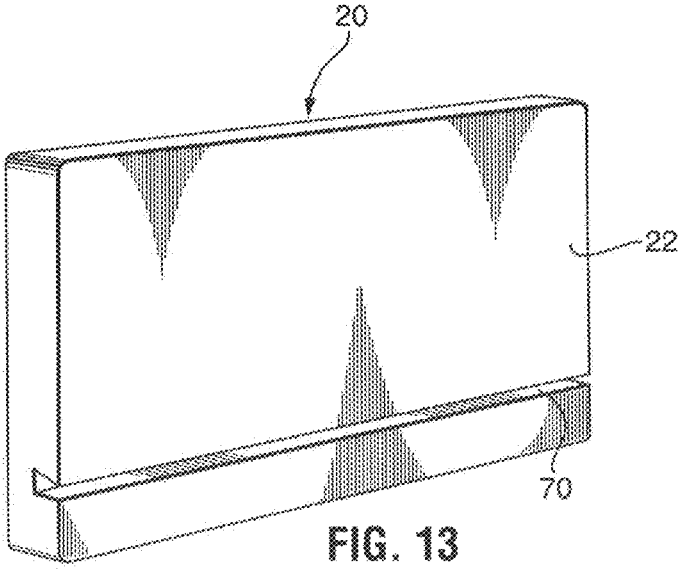
FIG. 13 is a rear perspective view of the facing panel of the modular siding panel of FIG. 10.

As is apparent from FIG. 7, the supporting spacer 40 further includes the water management portion 60, which includes at least one trough 64 for capturing water which has infiltrated at the top edge 26 all the way to the back surface 22 and at least one drainage channel 66 for draining the infiltrated water from the trough 64 downward. This trough 64 is formed by a rear surface of the mounting flange 46 and a ramped shoulder 63 above the attachment flange 50. The channel 66 is formed as a U-shaped channel connected to the trough 64 and having a pair of legs 67 for engagement with the back surface 22 of the facing panel 20 to form a drainage conduit which is somewhat sealed along the rear surface. In the installed condition of the spacer, the trough 64 is U-shaped and defined by the mounting flange 46, the shoulder 63 and the back surface 22 of the facing panel 20. As is readily apparent from FIG. 5C, any water which passes through the seam between the vertically stacked facing panels 20 between the top edge 26 and the bottom edge 28 and all the way to the back surface 22 will be captured in the trough 64 and maintained away from the building structure 14. As illustrated in FIG. 7, the trough 64 extends completely across the spacer 40 and, thus essentially all the way across the siding panel from the first side edge 30 of the facing panel 20 to the second side edge 32 of the facing panel 20 along the top edge 26 to form a trough 64 extending substantially over the full width of the facing panel. The shoulder 63, which forms the bottom of the trough 64 is provided with at least one drainage aperture 65 connected with the drainage channel 66. Preferably, the floor of the trough 64 is inclined from horizontal to slope downward towards the drainage aperture 65, as illustrated in FIG. 7. The U-shaped channel 66 extends downward towards the bottom edge of the spacer 40 and, thus, sufficiently downwards towards the bottom edge of the facing panel 28 to guide the drained water into the trough 64 of a like siding panel 12 positioned immediately below.

The drainage conduit, which in the installed condition is defined by the U-shaped drainage channel 66 and the back surface 22 of the facing panel 20 is at least partially sealed along the legs 67 to avoid lateral leakage of drained water from the conduit. In a variant of the preferred embodiment, the spacer further includes a wall upstanding from the shoulder 63 in order to form the U-shaped trough independent of the back surface 22 and the U-shaped channel 66 includes a lid or cap to form the drainage conduit independent of the back surface 22 (not illustrated).

In the preferred embodiment illustrated in FIGS. 3, 4A and 7, the water management portion 60 includes a trough 64 with three drainage apertures 65 and three associated drainage channels 66 with two channels respectively placed towards the ends of the spacer 40 and one channel at a location centrally therebetween. Most preferably, one of the U-shaped drainage channels 66 is placed directly at each of the ends of the spacer 40 in order for at least one drainage channel 66 to overlap in the installed condition the joint between the siding panel and a like siding panel immediately laterally abutting. This enables the capture of infiltrated water all around the facing panel in the installed condition, since the overlapping U-shaped channel 66 together with the trough 64 form a continuous trough which extends along the top edge and a side edge and therefore captures water infiltrated along the top and bottom edges 26, 28 or the side edges 30, 32 in the installed condition.

The supporting spacer 40 preferably also includes an installation aid in the form of interengageable upper and lower coupling elements for coupling of the bottom edge of one siding panel during installation to the top edge of another siding member directly below. These upper and lower coupling elements are provided in the form of a lower coupling flange 88 extending across the bottom edge of the supporting spacer 40 and laterally connecting the bottom ends 68 of the channels 66, and multiple upstanding upper coupling tabs 82 extending upward from the mounting flange 46 and defining a U-shaped gap 85 with the vertical supporting surface 15 for fittingly receiving the coupling flange 88 (FIG. 5C). The coupling flange 88 includes a lower attachment flange 87 for securing of the bottom edge of the spacer 40 to the facing panel 20. The lower attachment flange 87 includes fastener apertures 45 for receiving a fastener 41 to connect the lower attachment flange 87 to the back surface 22 of the facing panel 20. As is apparent from FIGS. 5A and 5C, a bottom edge 89 of the coupling flange 88 extends parallel to a top edge 41 of the mounting flange 46 and the coupling flange 88 is positioned on the rear surface 22 in proximity to the bottom edge 28, for the bottom edge 89 of the coupling flange 88 to rest in the installed condition of the siding panel 12 against the top edge 41 of the mounting flange 46. This automatically aligns vertically stacked siding panels 12 in parallel.

In a variant of the preferred embodiment, as illustrated in FIGS. 10-13, the lower attachment flange 87 included in the embodiment of FIGS. 4A, 5A-5C and 7, is replaced by multiple anchoring tabs 62 projecting from the coupling flange 88 and including an angled or hooked end 69 for retaining engagement with a lower retaining groove 70 in the back surface 22. The ends 69 and groove 70 are preferably of complementary shape and size to achieve a tight contact between the coupling flange 88 and the back surface 22.

Figure 14:
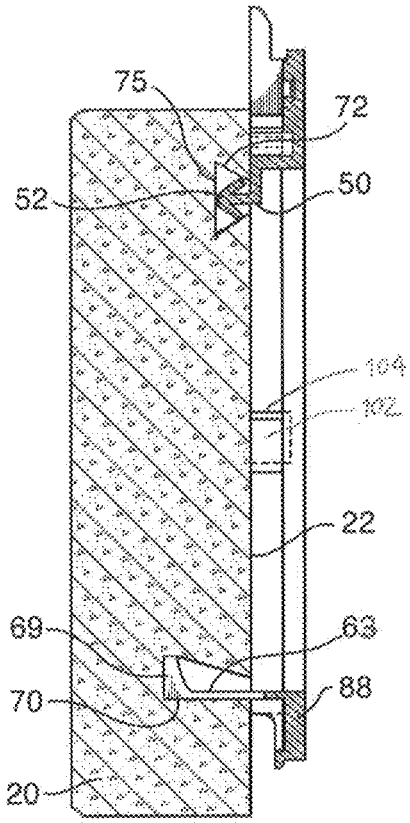
FIG. 14 is a cross-sectional view of a variant of the siding panel of FIG. 10, showing a manner of interlocking the mounting portion of the spacer with the facing panel.
Figure 15:
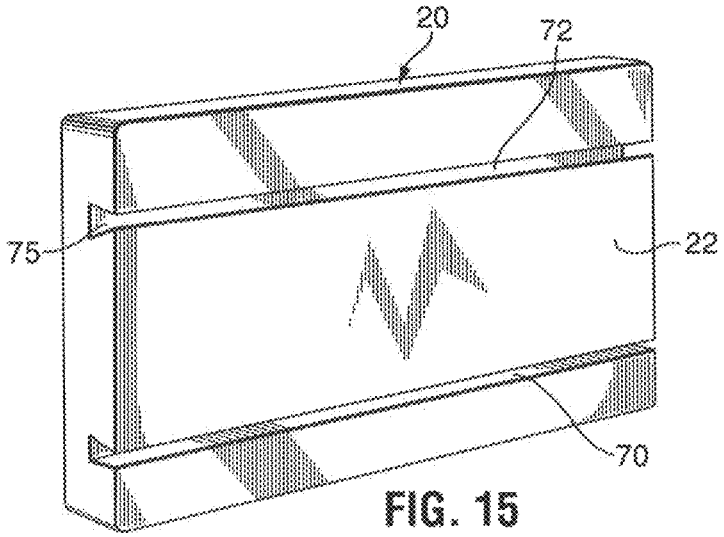
FIG. 15 is a rear perspective view of the facing panel of the modular siding panel of FIG. 14.
Figure 16:
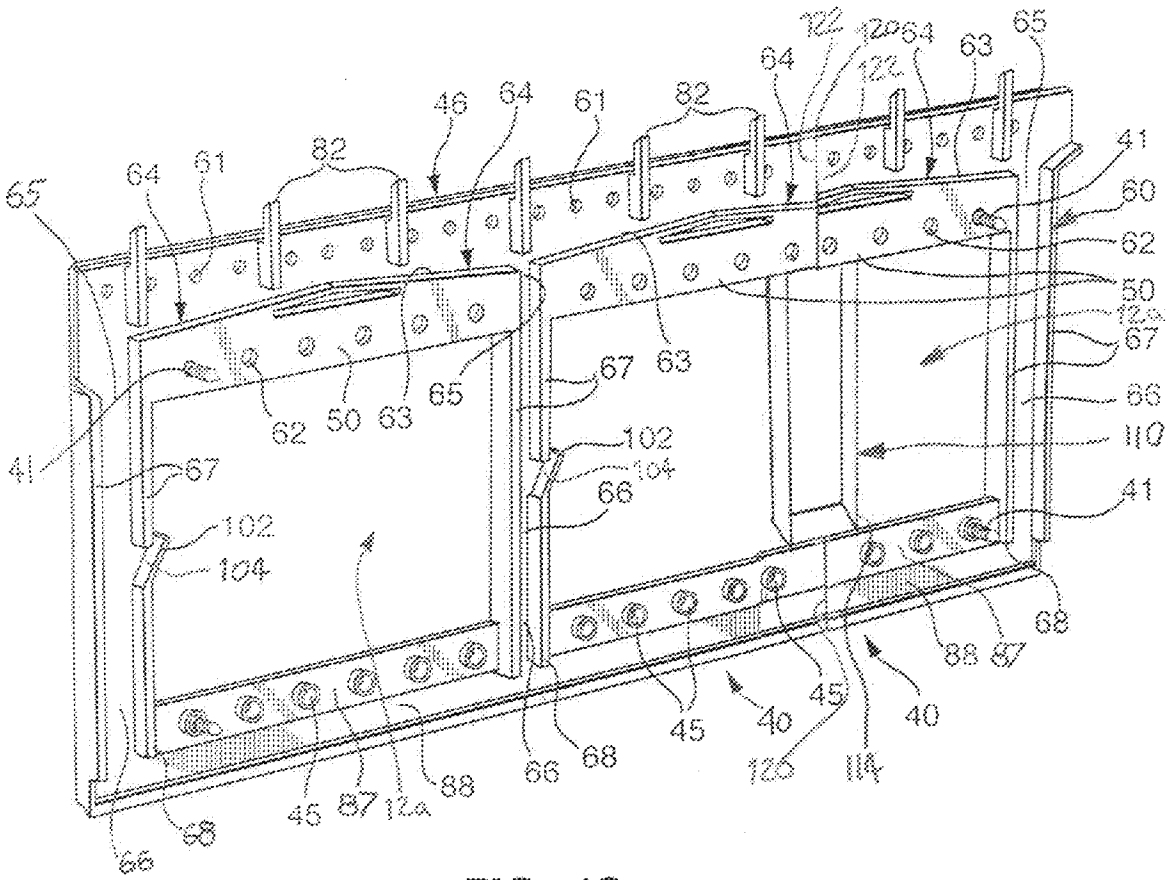
FIG. 16 is a rear perspective view of two spacers as shown in FIG. 7, each having a cut end and the cut spacers abutting at the cut ends and a channel insert bridging the abutting cut ends.

In another variant of the preferred embodiment, as illustrated in FIGS. 14-16, the coupling flange 88 and its connection to the facing panel 20 are the same as in the variant of FIGS. 10-13, while the attachment flange 50 at its lower end includes one or more arrow shaped latching clips 52, which snap into an upper retaining groove 72 in the back surface 22 of the facing panel and replace the fasteners 41 used in the variant of FIGS. 10-13. The latching clips 52 preferably permanently interlock with the upper retaining groove 70, which is flared from the rear surface inward and preferably has a dovetail cross-section 75 to accommodate the arrow shaped latching clips 52. Once inserted into the upper retaining groove 72, the narrow throat 73 of the groove prevents removal of the latching clips 52 from the groove 72. Although only a dove shaped retaining groove is illustrated, any retaining groove shape with a narrow throat close to the back surface 22 can be used, such as a keyhole shaped groove, etc. Equally, although latching clips 52 with arrow shaped, enlarged ends 52 are preferred, enlarged ends of different shape may be used as long as their shape allows insertion into the groove 72, while preventing removal thereafter. In general, any combination of groove and clip shapes can be used which allow for insertion of the clips into and interlocking of the clips with the retaining groove, so that the clips are reliably retained in the groove and their removal from the groove is reliably prevented to ensure a permanent interlocking engagement between the spacer 40 and the facing panel 20 at the coupling flange 88 and the attachment flange 50 in all weather conditions and even under incendiary conditions.

Sealing Infiltrated Water within Siding Panel

Despite the close clearances between vertically adjacent siding panels 12 in the installed condition, wind pressures may force infiltration of water past the top edge 26 of the facing panels 20 and towards the back surface 22. In the illustrated embodiment of the modular siding panel of the invention, the upper and lower attachment flanges 50, 87 and legs 67 of the channels 66 form a continuous line of contact with the back surface 22 to seal the drainage conduits within the modular siding panel. However, manufacturing tolerances in the spacer 40 and slight irregularities in the respectively contacting surfaces along the line of contact may create leakage points where infiltrated water may seep from the drainage conduit. Moreover, the point form fastening of the spacer to the facing panel may generate deformations in the vicinity of the attachment locations, which may cause localized seepage. In order to reliably drain the infiltrated water while sealed within the siding panel, such seepage must be counteracted. Of course, in the above discussed spacer variant which includes a U-shaped trough and closed drainage conduits, the drainage conduits are sealed even before connection of the spacer to the facing panel and leakage of the infiltrated water from the drainage conduits is avoided regardless.

For the basic design of the spacer in which the trough and the drainage channels are open, the inventors have now surprisingly discovered that this seepage can be minimized by providing the spacer with a pretension which will generate, in the installed condition of the spacer, a substantially continuous contact pressure between the water management portion and the rear face along the line of contact. This pretension is preferably achieved by providing the spacer 40 with a preselected curvature in at least one of its longitudinal and transverse directions for generation of a contact pressure between the spacer 40 and the back surface 22 along the drainage channels 66, when the spacer 40 is straightened against the facing panel 20 during fastening of the spacer 40 onto the back surface 22. The straightening of the spacer is achieved by fastening the upper and lower attachment flanges 50, 87 of the spacer 40 tightly against the rear surface 22. The pretension can be achieved by manufacturing the spacer in the curved condition or by bending a straight spacer to the desired curvature. When the spacer is made of thermoplastic material, molding the spacer in the curved condition is preferred to avoid local tension stress in the spacer that may lead to undesired deformation of the spacer at elevated ambient temperatures prior to installation of the spacer onto the facing panel.

The inventors have further discovered that a contact pressure of 5 lb/in$^2$ provided a satisfactory sealing action along the line of contact between the spacer 40 and the facing panel 20. Moreover, the inventors found that, independent of the material of which the spacer is manufactured, this contact pressure may be achieved by providing the spacer with a constant primary curvature over the whole width of the spacer at a minimum rate of curvature of at least ⅛ in for each 10 inches of spacer length. Even with a starting curvature of ¼ in/10 in spacer length and a manufacturing tolerance of ⅛ in/10 in of curvature, the minimum contact pressure of 5 lb/in$^2$ which was found to result in a satisfactory sealing action along the line of contact, was achieved (see Example 1). It was even more surprising that further providing the spacer with a second, lower degree of curvature in an orthogonal direction (⅛ in for each 10 in of spacer length) further improved the contact pressure to generally the same degree as the larger primary curvature (see Example 2). The primary curvature is preferably either in the horizontal or vertical direction of the spacer, while the secondary curvature is always orthogonal to the primary curvature. The spacer materials tested were polypropylene (PP), polypropylene with talc (PP+10 cc), polypropylene with added fiberglass (PP+30 fiberglass) and acrylonitrile butadiene styrene (ABS). A minimum contact pressure of 5 lbs per in$^2$ of contact surface along the line of contact was found to yield satisfactory sealing results, regardless of the spacer material used. Tests were conducted to determine the degree of curvature required to reliably achieve that minimum contact pressure along the line of contact between the spacer and the facing panel.

EXAMPLE 1

Contact pressure at the drainage channel 66 was measured for a primary curvature of ¼ in +/−⅛ in for each 10 in of spacer length in horizontal direction and measurements were taken along the line of contact. Minimum (MIN), average (NOM) and maximum (MAX) pressures were determined and are tabulated below. The spacers tested were made of different materials, namely polypropylene (PP), polypropylene with talc (PP+10 cc), acrylonitrile butadiene styrene (ABS) and polypropylene with added fiberglass (PP+30 fiberglass). As will be apparent, a minimum contact pressure of 5 lb/in2 was achieved regardless of the spacer material used.

Psi Study
Horizontal Axis
Curve dimension was ¼ ± ⅛

| | MIN | | | | NOM | | | | MAX | | | |
|---|---|---|---|---|---|---|---|---|---|---|---|---|
| | On 10" 0.125 | On 12.125" 21.25 | Lbs/lin in | Lbs/in$^2$ | On 10" 0.25 | On 12.125" 21.25 | Lbs/lin in | Lbs/in$^2$ | On 10" 0.375 | On 12.125" 21.25 | Lbs/lin in | Lbs/in$^2$ |
| PP | 5.60 | 4.41 | 0.36 | 5.60 | 9.60 | 7.56 | 0.62 | 9.59 | 12.00 | 9.45 | 0.78 | 11.99 |
| PP + 10 cc | 7.50 | 7.17 | 0.59 | 9.10 | 10.40 | 9.61 | 0.79 | 12.20 | 16.60 | 15.03 | 1.24 | 19.07 |
| ABS | 6.50 | 5.12 | 0.42 | 6.49 | 10.50 | 8.27 | 0.68 | 10.49 | 16.20 | 12.76 | 1.05 | 16.19 |
| PP + 30 fiberglass | 10.40 | 8.19 | 0.68 | 10.39 | 17.00 | 13.39 | 1.10 | 16.99 | 19.40 | 15.28 | 1.26 | 19.38 |

EXAMPLE 2

Contact pressure at the drainage channel 66 was measured for a primary curvature of ⅛ in +/−⅛ in for each 10 in of spacer length in vertical direction and measurements were taken along the line of contact. Minimum (MIN), average (NOM) and maximum (MAX) pressures were determined and are tabulated below. The spacers tested were made of different materials, namely polypropylene (PP), polypropylene with talc (PP+10 cc), acrylonitrile butadiene styrene (ABS) and polypropylene with added fiberglass (PP+30 fiberglass). As will be apparent, a minimum contact pressure of 5 lb/in$^2$ was achieved on average regardless of the spacer material used.

Psi Study
Vertical Axis
Curve dimension was ⅛ ± ⅛

| | MIN | | | | NOM | | | | MAX | | | |
|---|---|---|---|---|---|---|---|---|---|---|---|---|
| | On 10" 0.000 | On 5.443" 145.570 | Lbs/lin in | Lbs/in$^2$ | On 10" 0.125 | On 5.443" 145.570 | Lbs/lin in | Lbs/in$^2$ | On 10" 0.25 | On 5.443" 145.570 | Lbs/lin in | Lbs/in$^2$ |
| PP | 0.00 | 0.00 | 0.00 | 0.00 | 5.60 | 8.18 | 0.67 | 10.37 | 9.60 | 14.02 | 1.16 | 17.78 |
| PP + 10 cc | 0.00 | 0.00 | 0.00 | 0.00 | 7.50 | 10.95 | 0.90 | 13.89 | 10.40 | 15.18 | 1.25 | 19.27 |

-continued

| Psi Study<br>Vertical Axis<br>Curve dimension was ⅛ ± ⅛ | | | | | | | | | | | | |
|---|---|---|---|---|---|---|---|---|---|---|---|---|
| | MIN | | | | NOM | | | | MAX | | | |
| | On 10" 0.000 | On 5.443" 145.570 | Lbs/lin in | Lbs/in$^2$ | On 10" 0.125 | On 5.443" 145.570 | Lbs/lin in | Lbs/in$^2$ | On 10" 0.25 | On 5.443" 145.570 | Lbs/lin in | Lbs/in$^2$ |
| ABS | 0.00 | 0.00 | 0.00 | 0.00 | 6.50 | 9.49 | 0.78 | 12.04 | 10.50 | 15.33 | 1.26 | 19.45 |
| PP + 30 fiberglass | 0.00 | 0.00 | 0.00 | 0.00 | 10.40 | 15.18 | 1.25 | 19.27 | 17.00 | 24.82 | 2.05 | 31.49 |

Wind pressure on the building structure 14 may create significant pressure differences between the exterior of the building siding and the rear of the siding. Moreover, localized pressure peaks may be created behind the siding structure during gusty wind conditions. Therefore, steps are normally taken to equalize those pressure differences in an effort to reduce infiltration of water through the siding and potential entrapment of the infiltrated water behind the siding. Air pockets may be created between the supporting surface 15 and the facing panel 20, which may lead to an undesirable pressure differential between the front and rear sides of the siding panels during inclement weather conditions. In order to prevent such a pressure differential, at least one of the channels 66 is provided with a pressure vent 102 (see FIGS. 3, 4A, 5B, 5C, 7, 10, 11, 12, 14, 16 and 17). The pressure vent 102 is an opening in a sidewall of the U-shaped channel 66. Preferably, the opening is provided with an overlapping lip 104 (see FIGS. 7, 10, 11, 12, 14, and 16), which is upwardly inclined in the installed condition of the siding panel 12, in order to minimize the potential for leakage of the drained, infiltrated water from the vent 102.

The water management portion 60 is preferably made of a plastics material which is molded as a single part including the metal plate 43, so that during the molding process the plastics material of the water management portion 60 completely surrounds the metal plate 43, interlocks the two portions of the supporting spacer 40 and effectively shields the metal plate 43 from exposure to infiltrated water, thereby potentially extending the service life of the siding panel 12 (see FIGS. 5A-5C and 6).

The modular siding panel of the invention is preferably assembled by fastening the spacer 40 to a rigid facing panel of weather resistant material, either with fasteners 41 appropriate for the material of the facing panel, or by a combination of fasteners 41 and attachment tabs 62 fittingly received in a retaining groove 70 in the back surface 22 of the facing panel 20. After assembly, multiple siding panels 12 in accordance with this disclosure can be mounted to a building structure to form a weather resistant siding.

In order to start the installation of the siding from the base of the vertical support surface, a horizontal started rail 90 is installed as shown in FIG. 5B. The starter rail 90 has a U-shaped coupling member to receive the coupling flange 88 of a siding panel 12.

In practice, the siding panels 12 are manufactured in accordance with the structure described above. The vertical support surface 42 to which the siding panels 12 are to be secured is identified and the studs 16 (or other support members of the vertical support surface) are identified. The starter rail 90 is secured horizontally to the vertical supporting surface 42 and siding panels 12 are placed thereon side-by-side with the downwardly extending coupling flanges 88 seated within the U-shaped coupling member 100 of the starter rail 90. The first and second side edges 30, 32 of the facing panels 20 of adjacent siding panels 12 are mated and each siding panel 12 is secured in place by applying fasteners through the mounting flange and into one of the studs. Once a first row of siding panels has been installed in this manner, the next row of the siding panels 12 is installed by inserting the coupling flange 88 behind the coupling tabs 82 of the mounting flange 46 of the row of panels immediately below. The panels of successive rows are preferably staggered. This process is repeated for subsequent rows until the siding surface is completed.

With the foregoing in mind, the present self-supporting modular siding system 10 allows quick, easy and economical installation. Each siding panel 12 is fully supported by its own mounting flange. No mortar is required for installation. A lightweight concrete mix is preferably used in the manufacture of the siding panels 12 to allow for easy handling of the various side panels 12. In addition, profiles of the first and second side edges allow building interlocking corners using the same unit. The side face of the module is preferably textured similar to the facing surface 21 to imitate the face of the module for all corners.

Figure 17:
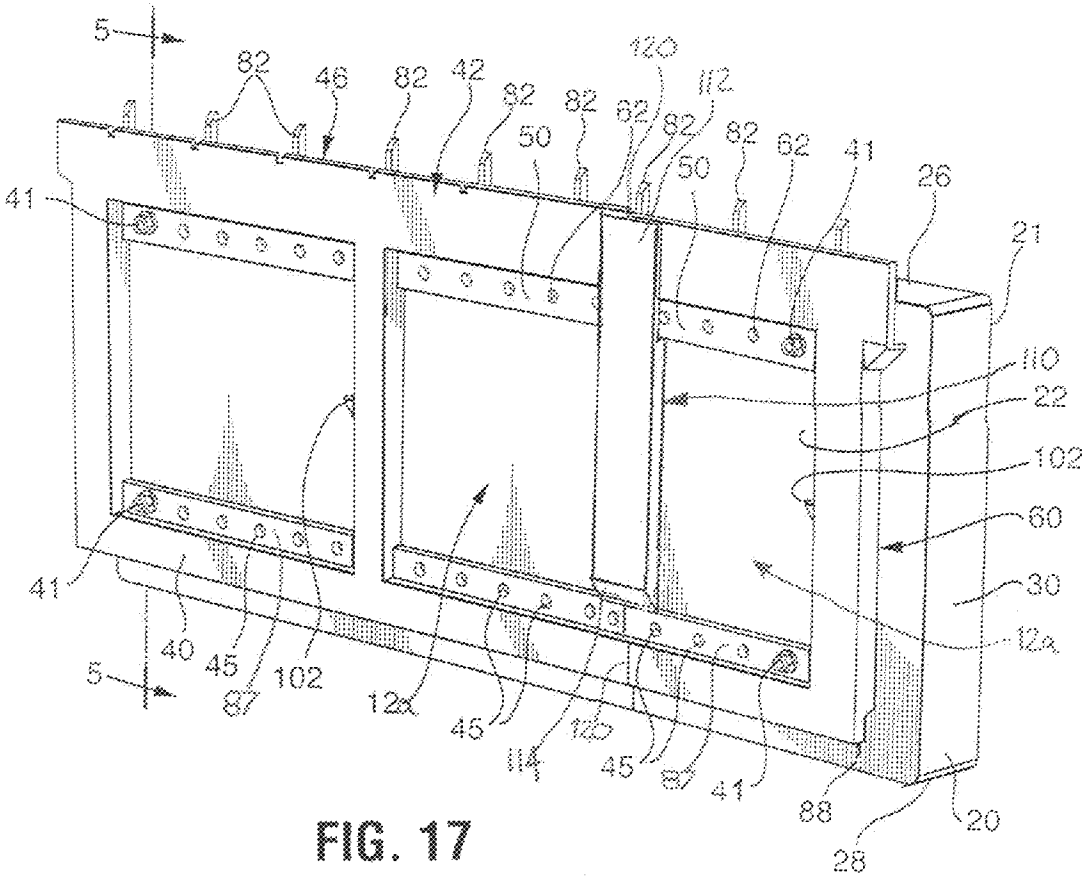
FIG. 17 is a rear perspective view of two cut siding panels as shown in FIG. 3, which are abutting cut end to cut end and illustrating a channel insert bridging the abutting cut ends.
Figure 18:
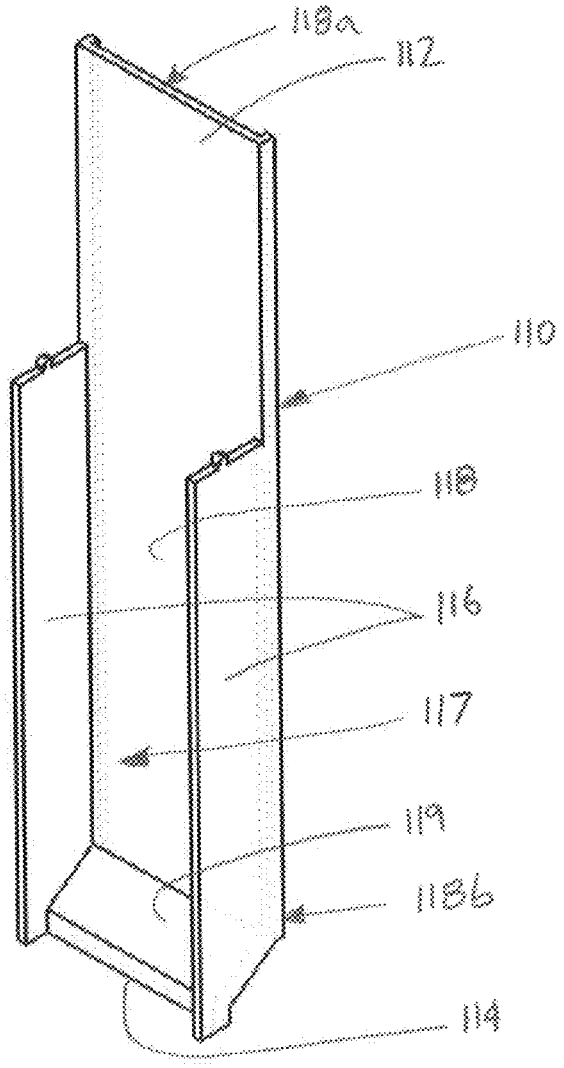
FIG. 18 is a perspective view in isolation of the channel insert shown in FIGS. 16 and 17.

FIG. 18 shows a U-shaped channel insert 110, which is illustrated in the installed condition in FIGS. 16 and 17. Although the spacer 40 includes end standing channels 66 which in the installed condition overlap a joint between the abutting side edges 30, 32 of an attached facing panel 20 and of an abutting facing panel of another siding panel 12, the size of the area to be covered with the siding panels 12 may require the use of shortened facing panels 12, cut to fit the available area. Since the spacer 40 protrudes on one side past the edge of the siding panel 12 and is recessed on the opposite end, the cut edge of a shortened siding panel 12*a* will no longer fit with either end of an uncut siding panel 12. Thus, each time a length adjustment must be made, two abutting siding panels 12 need to be cut to length in order to obtain cut side edges which can be abutted with little spacing between the cut facing panels 20 and spacers 40. However, those cut siding panels 12*a* will then no longer include any endstanding drainage channels 66 overlapping the joint between the cut ends. Even a close abutment of the cut edges cannot prevent water from seeping through the joint or crack between the abutting edges of the cut siding panels 12. The channel insert 110 was therefore developed to capture any water, which infiltrated through this abutment joint and to direct it to the bottom end of the cut siding panels 12*a*. The water infiltrated through the abutment joint is therefore either drained to the environment, if the abutting cut siding panels 12*a* are in the bottom row, or into the trough 64 of a lower row of siding panels 12. The channel insert 110 is inserted into the cut ends of the abutting spacers 40 (see FIGS. 16, 17) of the abutting cut siding panels 12*a*, to overlap the abutment joint 120 between the cut ends 122 of the abutting spacers 40 and abutting cut facing panels 20*a*. The channel insert 110 includes a base 118, which together with a pair of sidewalls 116 defines a U-shaped channel 117. The sidewalls 116 are sized to fit between the upper and lower attachment flanges 50, 88, in particular between the outside face of shoulder 63 in the upper attachment flange 50 and the upper edge 87 of the lower attachment flange 88. The base 118 has a top end 118*a* which in the installed condition is located at the top edge of the mounting flange 46 and a bottom end 118*b* which in the installed condition is located adjacent the upper edge 87. A ramped floor 119 extends from the bottom end 118*b* of the base 118, which in the installed condition directs water captured between the side walls 116 towards the back surface 22 of the facing panel 20 and around the upper edge 87 of the lower attachment flange 88. In the installed condition, the base 118 at the top end 118*a* bridges the joint between the cut ends 46*a* of the mounting flanges 46 and for the remainder forms a U-shaped channel 117 together with the sidewalls 116, for capturing water infiltrated through the joint between abutting cut ends of the facing panels 20. This means any water which has infiltrated through the joint between the lateral ends of the cut siding panels 12*a* is captured by the channel insert 110 and directed downward to the bottom edge of the cut siding panels 12*a*, in the same manner as the drainage channels 66 incorporated into the spacer 40. The side walls 116 each have a contact edge 115 for engagement with the back surface 22 of the facing panel 20 to form a U-shaped drainage channel 117 which is somewhat sealed along the rear surface 22. In the installed condition of the channel insert 110, the channel 117 is defined by the base wall 118, side walls 116 and the back surface 22 of the facing panel 20. As is readily apparent from FIGS. 16-18, any water which passes through the joint between abutting cut siding panels 12*a* will be captured in the trough 117 and maintained away from the building structure 14.

While the preferred embodiments have been shown and described, it will be understood that there is no intent to limit the invention by such disclosure, but rather, is intended to cover all modifications and alternate constructions falling within the spirit of and scope of the invention.

What is claimed is:

1. A modular siding panel for the assembly of a mortarless modular siding on a building structure, comprising a facing panel made of rigid, weather resistant material and having a front face exposed in an installed condition of the panel, a rear surface facing the building structure in the installed condition, and top, bottom and side edges for proximal placement to like panels positioned adjacent thereto; and a supporting spacer fastened to the rear surface of the facing panel, the spacer including a mounting portion for attachment of the modular siding panel to the building structure and a water management portion for capturing any infiltrated water which has seeped past the top edge and draining the captured infiltrated water, the water management portion engaging the rear surface for draining the infiltrated water out of contact with the building structure and away from the building structure and within the modular siding panel, between the rear surface and the water management portion.

2. The modular siding panel of claim 1, wherein the mounting and water management portion are integral portions of the supporting spacer and the captured infiltrated water is drained in a drainage conduit, the drainage conduit formed within the spacer or by sealing contact of a drainage recess in the spacer with the rear surface of the facing panel.

3. The modular siding panel of claim 2, wherein the mounting portion is a metal plate connected by fasteners to the facing panel and the water management portion is a plastics structure connected by fasteners to the facing panel.

4. The modular siding panel of claim 3, wherein the water management portion engages the rear surface along the top edge to define a trough for capturing the infiltrated water.

5. The modular siding panel of claim 4, wherein the trough extends substantially over a whole width of the facing panel.

6. The modular siding panel of claim 5, wherein the trough further extends along one of the side edges for capturing water which has seeped past that side edge.

7. The modular siding panel of claim 4, wherein the trough includes a drainage opening connected to the drainage conduit for channelling water flowing through the drainage opening toward the bottom edge of the siding panel.

8. The modular siding panel of claim 3, wherein the water management portion defines a U-shaped trough together with the rear surface of the facing panel, for capturing infiltrated water and water drained from the drainage conduit of a siding panel positioned directly above.

9. The modular siding panel of claim 1, wherein the supporting spacer includes a mounting flange formed by overlapping sections of the mounting and water management portions, for reinforcement of the supporting spacer at the point of securement to the building structure.

10. The modular siding panel of claim 9, wherein the mounting flange is made of metal for improved fire resistance of the modular siding panel and the mounting flange is embedded into the water management portion for corrosion protection.

11. The modular siding panel of claim 9, wherein the mounting flange extends along a top edge of the siding panel and the supporting spacer further includes coupling elements for slidingly coupling the bottom edge of the siding panel with the mounting flange of a like siding panel positioned immediately below.

12. The modular siding panel of claim 10, wherein the coupling elements include a lower coupling element positioned at a bottom end of the supporting spacer for engaging a top edge of the mounting flange of a like siding panel placed immediately below, and an upper coupling element extending upward from the mounting flange for gripping around the lower coupling element of another like panel placed immediately above.

13. The modular siding panel of claim 11, comprising a plurality of upper coupling elements, wherein the lower coupling element is a coupling flange integrated into the water management portion for placement onto an upper edge of the mounting flange of a like siding panel placed immediately below and the upper coupling elements are coupling tabs evenly spaced along the mounting flange for slidingly gripping the coupling flange of a like siding panel placed immediately above.

14. The modular siding panel of claim 11, wherein the mounting flange and coupling flange are parallel for automatic horizontal alignment of horizontally stacked like panels.

15. The modular siding panel of claim 1, wherein the facing panel is made of settable material.

16. The modular siding panel of claim 15, wherein the facing panel is a dry cast concrete panel.

17. A mortarless siding, comprising stacked rows of modular siding panels as defined in claim 1.

18. The siding of claim 17, further comprising a starter rail for supporting a lowermost horizontal row of the modular siding panels.

19. The siding of claim 18, wherein the starter rail includes a U-shaped supporting flange for receiving the coupling flange of the modular siding panels in the lowermost row.

20. The siding of claim 17, wherein the modular facing panels have a rectangular outline, or a Z-shaped outline with interlocking end portions.

21. The modular siding of claim 17, wherein the side edges of the modular facing panels tightly abut the side edges of laterally adjacent panels, while the top edges of each facing panel is closely spaced from the bottom edge of a like facing panel immediately above for generating an intermediate pressure equalization gap extending from the front surface to the back surface for each individual siding panel.

* * * * *